US005116197A

United States Patent [19]

Snell

[11] Patent Number: 5,116,197

[45] Date of Patent: May 26, 1992

[54] VARIABLE GEOMETRY DIFFUSER

[75] Inventor: Paul W. Snell, York, Pa.

[73] Assignee: York International Corporation, York, Pa.

[21] Appl. No.: 606,618

[22] Filed: Oct. 31, 1990

[51] Int. Cl.[5] ..... F04D 29/40

[52] U.S. Cl. ..... 415/126; 415/148

[58] Field of Search ..... 415/146, 148, 150, 157, 415/170.1, 126, 47, 48

[56] References Cited

U.S. PATENT DOCUMENTS

| | | | |
|---|---|---|---|
| 3,032,259 | 5/1962 | Jassniker . | |
| 3,349,997 | 10/1967 | Beran et al. . | |
| 3,841,789 | 10/1974 | Corrigan et al. | 415/148 |
| 3,941,498 | 3/1976 | Duckworth et al. | 415/46 |
| 3,963,369 | 6/1976 | Balje | 415/148 |
| 4,338,063 | 7/1982 | Nakanishi | 415/164 |
| 4,353,507 | 10/1982 | Kah, Jr. | 239/240 |
| 4,416,583 | 11/1983 | Byrne | 415/148 |
| 4,484,857 | 11/1984 | Patin | 415/150 |
| 4,527,949 | 7/1985 | Kirtland | 415/150 |
| 4,544,325 | 10/1985 | Rogo et al. | 415/150 |
| 4,718,819 | 1/1988 | Rogo et al. | 415/149 R |
| 4,741,666 | 5/1988 | Shimizu et al. | 415/158 |
| 4,770,605 | 9/1988 | Nakatomi | 415/148 |
| 4,844,690 | 7/1989 | DeLaurier et al. | 415/148 |
| 4,932,835 | 6/1990 | Sorokes | 415/157 |
| 4,969,798 | 11/1990 | Sakai et al. | 415/157 |

FOREIGN PATENT DOCUMENTS

| | | | |
|---|---|---|---|
| 628826 | 10/1961 | Canada . | |
| 140594 | 8/1982 | Japan | 415/157 |
| 353837 | 6/1961 | Switzerland . | |

*Primary Examiner*—John T. Kwon

*Attorney, Agent, or Firm*—Finnegan, Henderson, Farabow, Garrett & Dunner

[57] ABSTRACT

A system for stabilizing the flow of fluid in a variable capacity compressor having a diffuser, the capacity of which can be varied by changing the relative position of fixed diffuser surface and a movable diffuser surface. The system includes an annular push ring connected to the movable diffuser surface by a plurality of pins. The annular push ring is axially displaceable and rotatably fixed. Axial displacement of the annular push ring axially displaces the movable diffuser surface. The system also includes a drive ring mounted on a nozzle base plate for driving the annular push ring. The drive ring is axially displaceable and rotatable. Rotation of the drive ring axially displaces the drive ring, the push ring, and the movable diffuser surface.

21 Claims, 5 Drawing Sheets

VARIABLE GEOMETRY DIFFUSER

BACKGROUND OF THE INVENTION

1. Field of the Invention

The present invention relates to a system for stabilizing the fluid flow in a variable capacity compressor.

2. Description of the Prior Art

Conventional compressors may be operated over a broad range of loads. As the load varies, it is necessary to stabilize the fluid flow in the compressor. A low flow rate may cause instability of the flow, thereby allowing the formation of rotating stall pockets or cells in the diffuser which create noise, cause vibration, and lower compressor efficiency. This condition is known as incipient surge or stall. If the flow becomes even more unstable, complete reversals of fluid flow in the diffuser may occur. This phenomenon, known as surge, is characterized by fluid alternately surging backward and forward through the compressor. Surge creates noise, causes vibration, lowers compressor efficiency, creates heat, and can cause damage to the compressor. Varying the geometry of the diffuser by altering the diffuser width is a recognized method of stabilizing the fluid flow.

Several devices for varying the diffuser width are disclosed in the prior art. For example, U.S. Pat. No. 4,527,949 to Kirtland discloses a device in which hydraulic fluid is delivered under pressure into a first expandable chamber to move a movable diffuser surface toward a fixed diffuser surface and thereby decrease the width of the diffuser. Providing fluid under pressure in a second expandable chamber causes movement of the movable diffuser surface away from the fixed diffuser surface and thereby increases the width of the diffuser Another type of hydraulic system uses spring pressure to urge the movable diffuser surface in the direction of the fixed diffuser surface. In this system a low pressure area is produced behind the movable diffuser surface to counteract the force of the spring and to move the movable diffuser surface in a direction away from the fixed diffuser surface. A system of this type is shown in U.S. Pat. No. 4,416,583 to Burns.

Such hydraulic systems often use a piston and cylinder arrangement having a single large diameter piston. In the inventor's opinion, the length to diameter ratio of the piston is usually very low due to the small amount of axial space available inside the compressor housing. The low length to diameter ratio increases the possibility of jamming of the piston in the cylinder. To achieve a reliable length to diameter ratio, it would be necessary to increase the axial length of the compressor.

Such hydraulic systems may use multiple pistons instead of a single piston. It is the inventor's experience that an almost perfectly matched set of pistons is necessary to allow the pistons to move in unison. If the pistons are not matched closely enough, jamming can occur.

In hydraulic systems, uneven frictional force on the piston seals can cause the movable diffuser surface to become misaligned and jam. The piston seals themselves are also a source of concern, because if a seal fails, it may render the diffuser system totally inoperative. Seal leakage allows excessive oil to enter the compressor discharge gas, thereby affecting performance of the heat transfer surfaces. Seal leakage may also hamper proper operation of the compressor by bleeding pressure away from the hydraulic system. Hydraulic systems generally do not allow for a mechanical override. A breakdown in the hydraulic system therefore prevents the movement of the movable diffuser surface by other means. In addition, in a hydraulic system the movable diffuser surface needs to be rather stiff to reduce the possibility of warping. Warping of the movable diffuser surface can cause jamming. This stiffness requirement translates into increased weight and inertia.

Pneumatic systems are also in the prior art. A pneumatic, or refrigerant gas, actuated system operates in substantially the same manner as the hydraulic system. In this system the liquid of the hydraulic system is replaced by a gas from the compressor discharge. The pneumatic piston is designed similarly to the piston of the hydraulic system and therefore suffers from the jamming caused by the low length to diameter ratio. Pneumatic systems also have reliability problems for many of the same reasons stated above in regard to the hydraulic system.

Some mechanical systems can be found in the prior art. An example of a mechanical system is shown in U.S. Pat. No. 3,032,259 to Jassniker. The mechanical systems used in the past require a great deal of space along the centerline of the compressor and therefore increase the axial length of the compressor. Known mechanical systems do not achieve a desirable degree of compactness.

In summary, while a number of different systems have been used in the past for varying the diffuser width, those systems present a number of problems.

SUMMARY OF THE INVENTION

An object of the invention is to provide an improved variable geometry diffuser system which overcomes the problems associated with the prior art systems.

Another object of the invention is to provide a variable geometry diffuser system having improved reliability.

Still another object of the invention is to provide a variable geometry diffuser system which can be operated manually, or by a primary hydraulic, pneumatic, or electric control, with a secondary manual override.

Another object of the invention is to provide a variable geometry diffuser system which has a relatively small axial length.

Additional objects and advantages of the invention will be set forth in part in the description which follows, and in part will be obvious from the description, or may be learned by practice of the invention. The objects and advantages of the invention will be realized and obtained by means of the elements and combinations particularly pointed out in the appended claims.

To achieve the foregoing objects and in accordance with the purpose of the invention, as embodied and broadly described herein, the invention comprises a system for stabilizing the flow of fluid in a variable capacity compressor having a housing and a diffuser, the capacity of which can be varied by changing the relative position of a fixed diffuser surface and a movable diffuser surface, the system including means connected with the movable diffuser surface for moving the movable diffuser surface, the moving means being axially displaceable and rotatably fixed, axial displacement of the moving means axially displacing the movable diffuser surface, means connected with the moving means for driving the moving means, the driving means being axially displaceable and rotatable relating to the moving means, axial displacement of the driving means axially displacing the movable diffuser surface, the moving means being slidably received on the driving means and located radially adjacent to the driving means.

In a preferred embodiment, the variable geometry diffuser system of the present invention includes an actuator outside the compressor housing and a mechanical arrangement which translates the movement of the actuator into axial movement of the movable diffuser surface.

In the preferred embodiment, the diffuser width is adjusted in relation to pre-rotation vane position or compressor head and flow to help stabilize the fluid flow, thereby delaying the onset of diffuser stall and surge, and achieving noise reduction.

The preferred embodiment provides a mechanical system which is configured so as to reduce the possibility of jamming or binding, thereby increasing reliability. The mechanical system of the preferred embodiment is capable of being operated manually. Preferably, many of the components of the preferred embodiment can be relatively small amount of space along the centerline of the compressor.

Additionally, the present invention has the advantages of low weight, ease of manufacture, shock and vibration resistance, good system performance, and an inherently high back impedance which will help prevent unintentional creep or movement of the diffuser ring.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate presently preferred embodiments of the invention and together with the general description given above and the detailed description of the preferred embodiments given below, serve to explain the principles of the invention. Of the drawings.

DESCRIPTION OF THE PREFERRED EMBODIMENTS

Reference will now be made in detail to the presently preferred embodiments of the invention, examples of which are illustrated in the accompanying drawings. Wherever possible, the same reference numbers will be used throughout the drawings to refer to the same or like parts.

Figure 1:
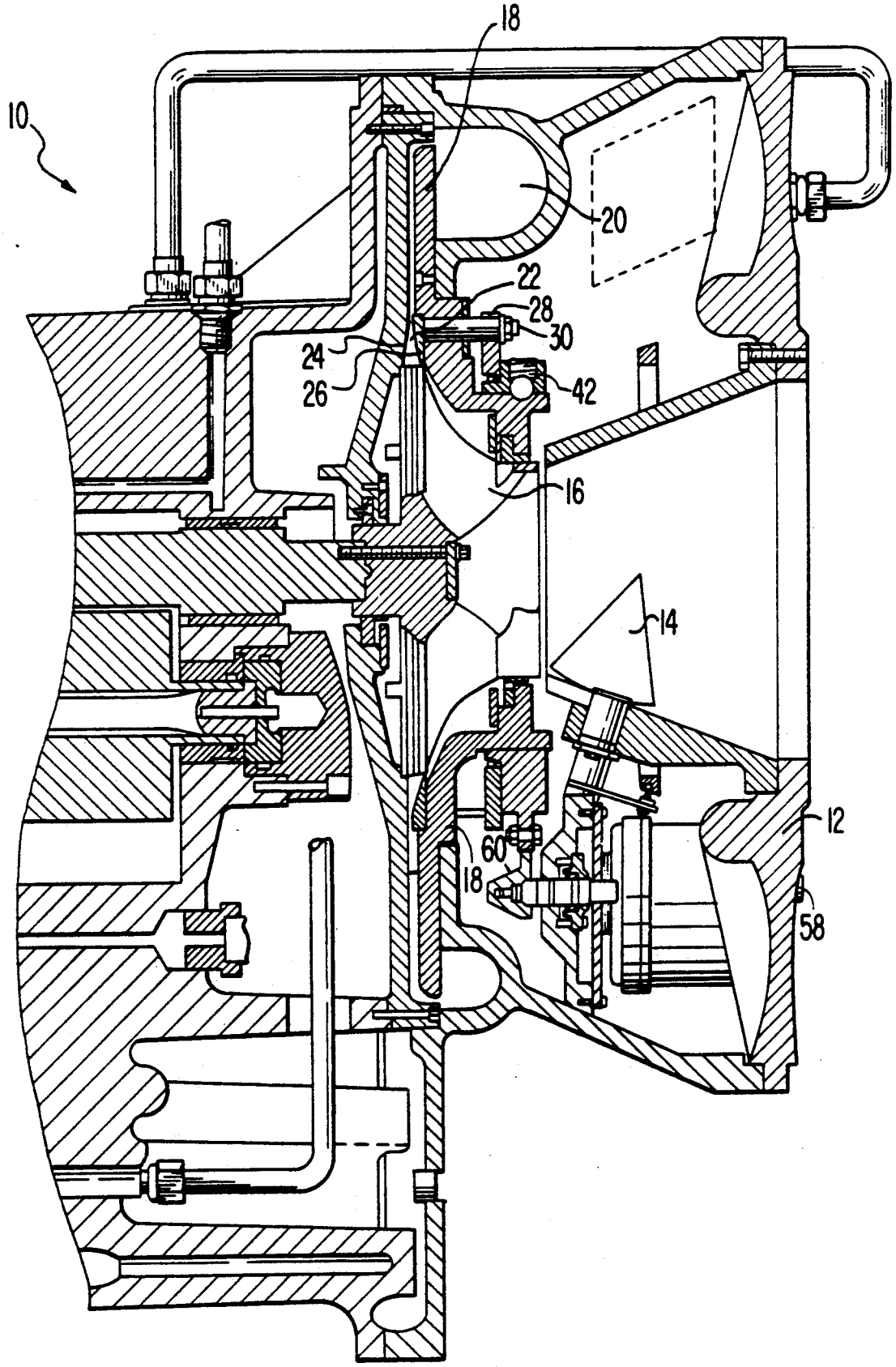
FIG. 1 is a section view of a compressor illustrating a preferred embodiment of the present invention.

As shown in FIG. 1, the present invention is designed for use in a centrifugal compressor 10. The centrifugal compressor 10 includes a compressor housing 12, pre-rotation vanes 14 for capacity control, an impeller 16, a base or nozzle base plate 18, a volute 20, and a diffuser 22 at the entrance to the volute 20. The diffuser 22 includes a fixed diffuser surface 24 and a movable diffuser surface 26. In the embodiment shown, the movable diffuser surface 26 is an annular diffuser ring, although the movable surface can be an entire movable wall. Preferably, the movable diffuser surface 26 is an annular ring formed of somewhat flexible lightweight aluminum, although iron or steel would be acceptable. The movable diffuser surface 26 is movable relative to the fixed diffuser surface 24 to alter the width of the diffuser 22.

Figure 2:
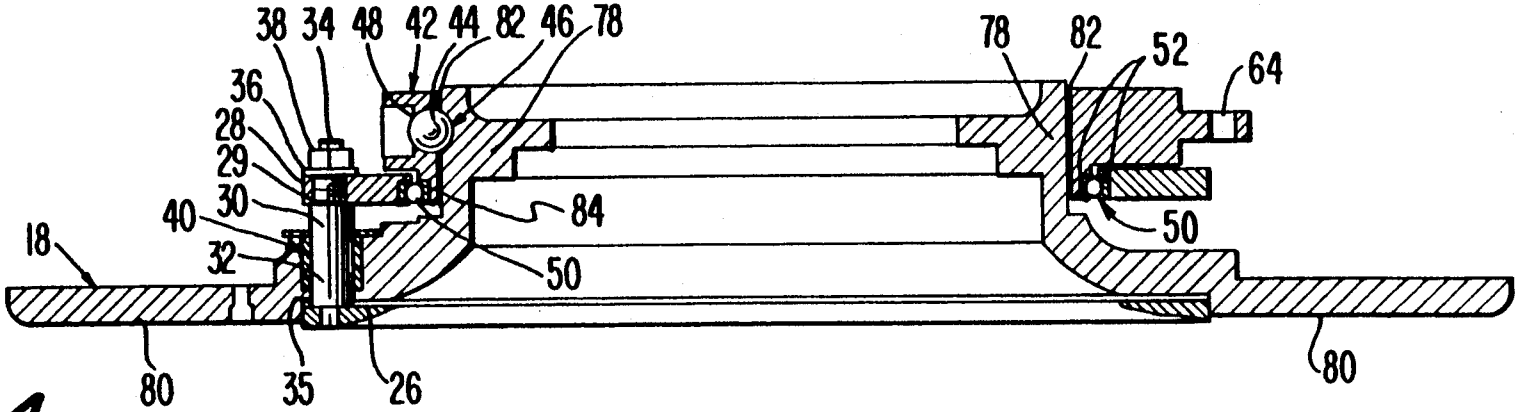
FIG. 2 is an enlarged section view of the preferred embodiment.

In accordance with the invention, means are provided for moving the movable diffuser surface 26 relative to the fixed diffuser surface 24. As embodied herein and as best shown in FIG. 2, the moving means includes an annular push ring 28 and means for connecting the annular push ring 28 to the movable diffuser surface 26. As embodied herein, the means for connecting the annular push ring 28 to the movable diffuser surface 26 includes a plurality of pins 30. Preferably, six pins 30 are equidistantly spaced about the annular push ring 28. The pins 30 have sliding portions 32 and threaded portions 34. The pins 30 can be ground and chrome plated on the sliding portions 32 to increase smoothness.

The threaded portions 34 of the pins 30 are inserted in holes 29 in the annular push ring 28. Washers 36 are placed on the threaded portions 34 and nuts 38 are tightened along the threaded portions 34 to fix the pins 30 to the annular push ring 28. The pins 30 extend through holes 35 in the nozzle base plate 18 and are fixedly connected to the movable diffuser surface 26 by conventional means. For example, the pins can be bolted, welded, or brazed into the ring. In the preferred embodiment, the pins 30 are fixedly connected to the movable diffuser surface 26 by a threaded portion on the pins 30 that threads into threads cut into threaded holes in the ring 26. Because the pins 30 extend through the holes 35 in the base plate and because the base plate is fixed to the compressor housing, the pins prevent rotational movement of the annular push ring 28.

In the preferred embodiment, sleeves 40 are inserted into holes 35 in the nozzle base plate. These sleeves 40 are sized to create a seal between the pins 30 and the nozzle base plate 18. The sleeves 40 may, for example, be formed from polytetrafluoroethylene, sold under the trademark TEFLON, or carbon impregnated nylon. The use of such sleeves 40 eliminates the need for any direct lubrication of the pins 30.

Figure 3:
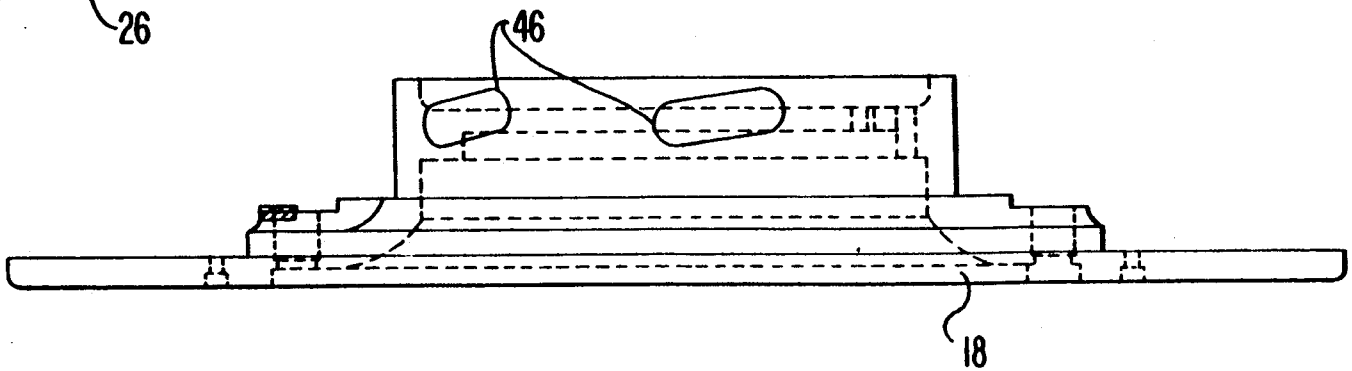
FIG. 3 is a side view of the nozzle base plate of the preferred embodiment.
Figure 4:
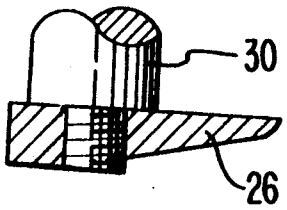
FIG. 4 is a partial section view of the movable diffuser surface of the preferred embodiment shown in FIG. 1.

In accordance with the invention, means are provided for driving the annular push ring 38 and the pins 30. As embodied herein, the driving means includes the nozzle base plate 18 and a drive ring 42 mounted on a projecting portion of the nozzle base plate 18, preferably via a ball bearing arrangement. As shown in FIG. 2, the base plate 18 is generally annular in shape and is fixed to the outer housing of the compressor by conventional means. The nozzle base plate 18 includes a generally projecting portion 78 which extends axially away from the base portion 80 of the nozzle base plate 18. The projecting portion 78 includes a generally cylindrical outer surface 82 onto which the annular drive ring 42 is mounted. The ball bearing arrangement used in the preferred embodiment to rotatably connect the drive ring 42 to nozzle base plate 18 includes balls 44 which ride in special tracks or races 46 machined into the cylindrical outer surface 82 of nozzle base plate 18. As best shown in FIG. 3, these races 46 are machined in a screw thread like pattern about the centerline of the compressor 10. The balls 44 also ride in spherical pockets 48 spaced equidistantly about the inside diameter of the drive ring 42. The number of races 46 corresponds to the number of spherical pockets 48 and balls 44.

When the drive ring 42 is mounted onto the cylindrical outer surface 82 of the nozzle base plate 18, the nozzle base plate 18 and drive ring 42 have a common axis, and the drive ring 42 is positioned radially outward of the cylindrical outer surface 82. When the drive ring 42 is rotated relative to the nozzle base plate 18 and about the centerline of the compressor 10, it advances axially because of the movement of the balls 44 in the races 46. The drive ring 42 is capable of movement in the axial direction until the balls 44 come into contact with the ends of races 46. The ball bearing arrangement thus allows for a slidable connection between the drive ring 42 and the nozzle base plate 18 which converts rotational movement of the drive ring 42 into axial movement and also prevents the drive ring 42 and the nozzle base plate 18 from becoming disconnected.

Figure 6:
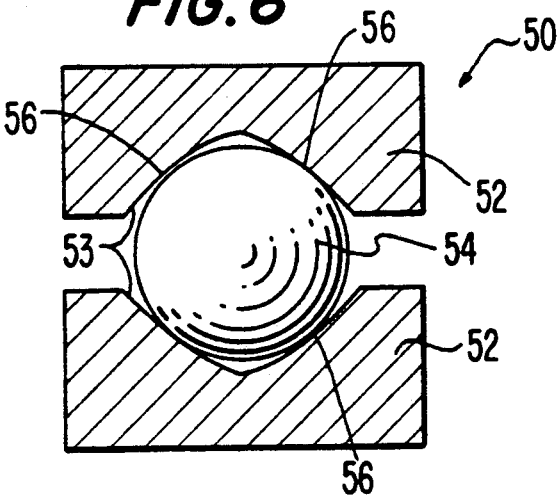
FIG. 6 is a partial section view of a bearing used in the preferred embodiment.
Figure 7:
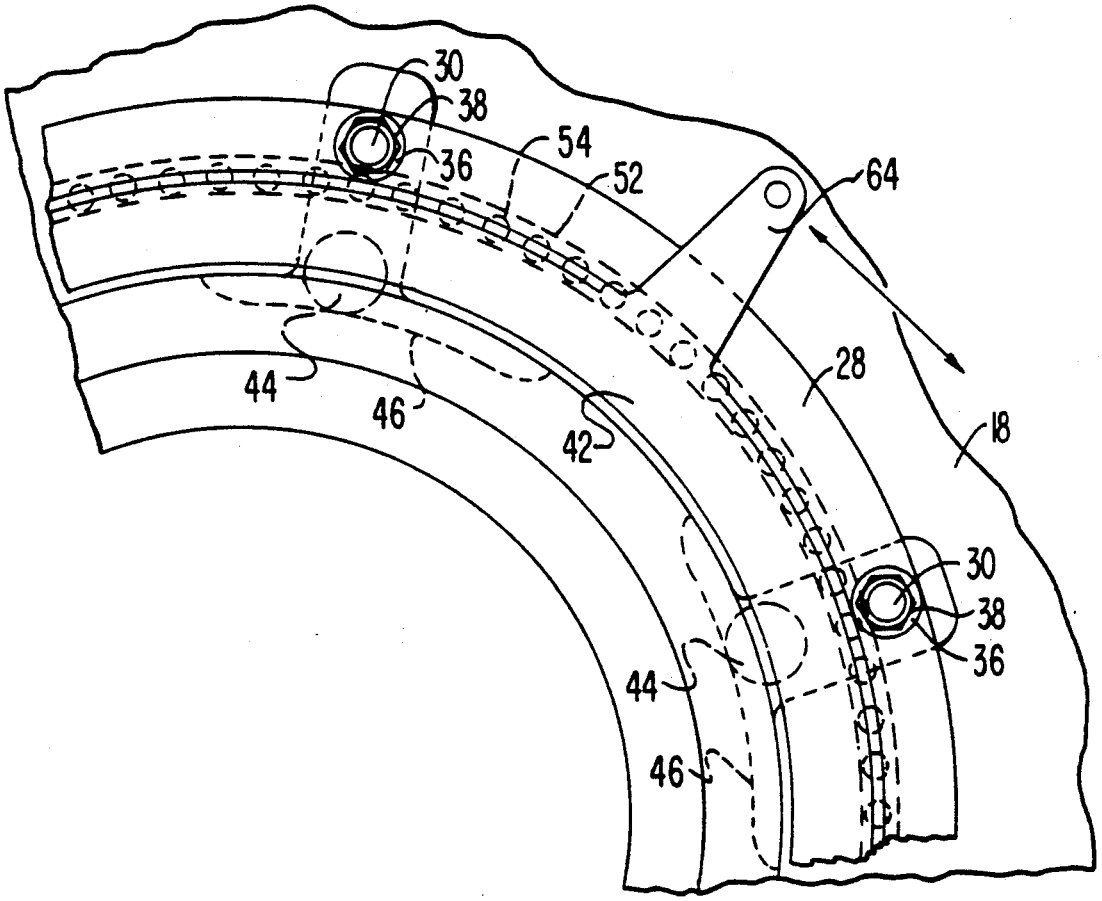
FIG. 7 is a partial plan view of the preferred embodiment shown in FIG. 1.

The drive ring 42 is slidably interconnected to the push ring 28 so that the axial movement of the drive ring 42 upon rotation can be translated to the push ring. As shown in FIG. 2, the drive ring 42 includes an inwardly extending annular flange 84 that is positioned radially inside the push ring 28. In the preferred embodiment, the drive ring 42 and push ring 28 are interconnected by bearing 50. As shown, bearing 50 is positioned on the outer circumference of the drive ring 42 and on the inner circumference of the push ring 28. As shown in FIG. 6, the bearing 50 has two races 52, one of which is fixed to the drive ring 42 and the other of which is fixed to the push ring 28. The running surfaces 53 of the races 52 preferably have a cross sectional shape similar to a gothic arch The gothic arch shape causes the balls 54 to have two points of contact 56 with each of the races 52. This structure allows the bearing 50 to operate while subjected to force in both the radial and axial directions. This arrangement allows the drive ring 42 and the annular push ring 28 to rotate relative to each other while, simultaneously, preventing the drive ring 42 and annular push ring 28 from moving axially relative to each other.

Figure 5:
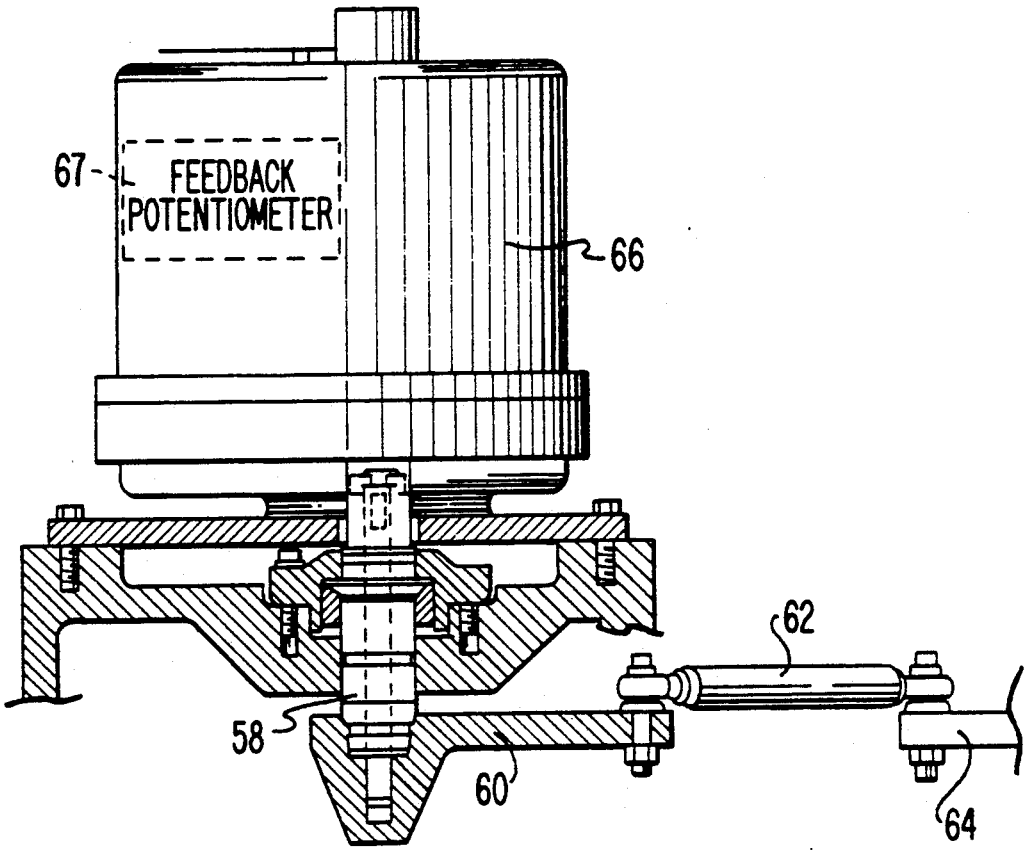
FIG. 5 is a partial section view of control elements of the preferred embodiment.

In accordance with the invention, means are provided for rotating the drive means. As embodied herein and as shown in FIG. 5, the rotating means includes a control shaft 58, a lever arm 60, an adjustable link 62, and a knuckle 64 located on the drive ring 42. One end of the control shaft 58 extends outside of the compressor housing 12. The other end of the control shaft 58 is connected to the lever arm 60. The lever arm 60 is connected to the adjustable link 62, which is connected to a knuckle 64 on the drive ring 42. Rotation of the control shaft 58 causes rotation of the drive ring 42 via the lever arm 60 and the adjustable link 62.

Rotation may be imparted to the control shaft 58 via an electric motor or a piston device. Additionally, a piston device could be directly connected to the drive ring 42 to cause rotational movement thereof. In the preferred embodiment shown in the drawings, control shaft 58 is connected to a direct drive electrically operated actuator 66. The actuator 66 has a feedback potentiometer 67 which operates as a position sensor The feedback potentiometer 67 indicates the position of the actuator 66, and the position of the movable diffuser surface 26 can be determined from that information. The position sensor may be located in the actuator 66.

In accordance with the invention, means are provided for controlling the axial position of the movable diffuser surface 26 with respect to the position of the capacity control means. As embodied herein, the controlling means includes an electronic control device, such as a microprocessor, which determines the desired position of the movable diffuser surface 26 based upon the position of the pre-rotation vanes 14. The control device receives a signal from a position sensor of a pre-rotation vanes actuator. The control device determines the position of the prerotation vanes 14 from the signal received from the position sensor and then determines the corresponding optimal position of the movable diffuser surface 26. The control device then sends a signal to the actuator 66 to cause the movable diffuser surface 26 to be moved into the proper position. The position sensor of the actuator 66 indicates when the proper position has been reached.

The present invention operates as follows. As the chiller load decreases, the pre-rotation vanes 14 will begin to close in order to maintain the temperature of the exiting water. A feed back potentiometer in the pre-rotation vanes actuator indicates the position of the pre-rotation vanes 14. The electronic control panel senses the position of the vanes, determines the corresponding proper position for the movable diffuser surface 26, and transmits a control signal to the actuator 66. The actuator 66 is also equipped with a feedback potentiometer 67 to sense the position of the movable diffuser surface 26. The actuator 66 imparts rotational movement to the control shaft 58. The control shaft 58 moves the lever arm 60 which causes a corresponding rotational movement of the drive ring 42. Rotation of the drive ring 42 causes the balls 44 to move in the races 46 on the nozzle base plate 18. The movement of the balls 44 in the races 46 causes the balls 44 and the drive ring 42 to move axially. As the drive ring 42 rotates and moves axially, the annular push ring 28 will remain rotatably fixed due to the pins 30, but will move axially along with the drive ring 42. The pins 30 will transfer the axial movement of the annular push ring 28 to the movable diffuser surface 26. Thus, rotational movement of the actuator 66 will cause an axial movement of the movable diffuser surface 26.

Figure 8:
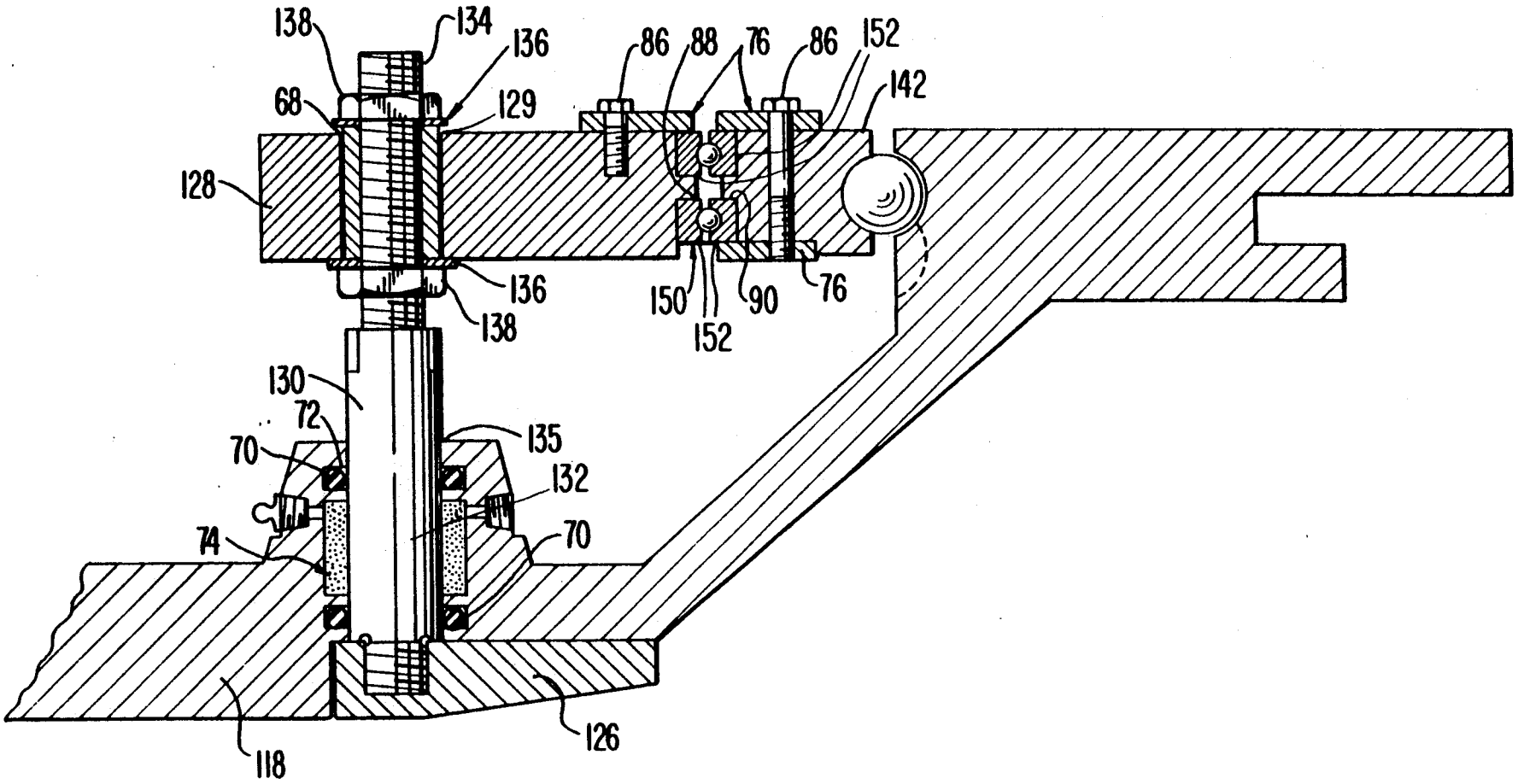
FIG. 8 is a partial section view of a second embodiment of the invention.

FIG. 8 illustrates a second embodiment of the present invention. Bearings 150 are positioned on the outer circumference of the drive ring 142 and on the inner circumference of the push ring 128. The bearings 150 each have two races 152, one of which is fixed to the drive ring 142 and the other of which is fixed to the push ring 128. Similar to the first embodiment, the running surfaces of the races 152 preferably have a cross sectional shape similar to a gothic arch. Retaining plates 76 are connected to the push ring 128 and the drive ring 142 by conventional connecting means, such as bolts 86. The retaining plates maintain the bearings 150 in position by forcing the bearings 150 against a protrusion 88 on the push ring 128 and a protrusion 90 on the drive ring 142.

In the second embodiment of the invention, six pins 130 are equidistantly spaced about the annular push ring 128 in the same fashion as the first embodiment. The pins have sliding portions 132 and threaded portions 134. The pins 130 can be ground and chrome plated on the sliding portions 132 to increase smoothness.

The threaded portions 134 of the pins 130 are inserted in holes 129 in the annular push ring 128. Ferrules 68 are placed between the annular push ring 128 and the threaded portions 134. Washers 136 are placed on the threaded portions 134 at each end of the ferrules 68. Nuts 138 are tightened along the threaded portions 134 to fix the pins 130 to the annular push ring 128. The pins 130 extend through holes 135 in the nozzle base plate 118 and are fixedly connected to the movable diffuser surface 126 in the same manner as the first embodiment.

Also in the second embodiment, O-rings 70 are inserted into grooves 72 in the holes 135 in the nozzle base plate 118. These O-rings 70 are sized to create a seal between the pins 130 and the nozzle base plate 118. The O-rings 70 may, for example, be formed from polytetrafluoroethylene, sold under the trademark TEFLON, or carbon impregnated nylon. Lubricant is provided via grease pockets 74, located in the holes 135, to lubricate the pins 130 and decrease the frictional force between the pins 130 and the nozzle base plate 118.

The second embodiment provides the advantages of adjustability of the position of the movable diffuser surface 126 via nuts 138 and threaded portions 134 and also the use of non-gothic arch type bearings.

The remaining components and the operation of the second embodiment are substantially similar to the first embodiment and a description thereof will not be repeated.

The present invention provides a compact and durable system for adjusting the position of a variable diffuser. The projecting portion of the base plate, the drive ring, and the push ring are all axially aligned with and radially disposed from each other. The projecting portion is positioned radially within the drive ring, and the drive ring in turn is positioned radially within the push ring. The push ring and drive ring do not extend axially beyond the projecting portion of the base plate. As a result, the device is extremely compact, axially. For example, in the preferred embodiment the nozzle base plate has a diameter of 27.2 inches and a height of 4.2 inches. The drive ring has a diameter of 13.5 inches and a height of 2.0 inches. The push ring has a diameter of 16.5 inches and a height of 0.57 inches. Because the nozzle base plate, the drive ring, and the push ring are aligned in the radial direction, the combination of the three components only has a height, or axial length, of 4.2 inches, the height of the nozzle base plate.

The present invention decreases the possibility of jamming of the variable geometry diffuser, thereby increasing reliability. The length to diameter ratio of the pins is relatively large, which decreases the possibility of the pins jamming in the holes. For example, a pin having a length of 3.437 and a diameter of 0.748 is preferred, providing a length to diameter ratio of approximately 4.6:1. The possibility of jamming is further decreased when the movable diffuser surface is somewhat flexible The movable diffuser surface of the present invention can be flexible because it is a ring having a small outside diameter to inside diameter ratio. A moderately flexible movable diffuser surface allows the pins to float independently, thereby decreasing the possibility of binding or jamming. Any flexing of the movable diffuser surface will be minor, and will not impair the fluid dynamic performance of the device.

The present invention decreases the possibility of leaks developing in the compressor. The holes in the nozzle base plate, which are required to accommodate the device for connecting the movable diffuser surface to the moving means, represent an area of potential leakage. The possibility of leakage is reduced in the present invention by decreasing the size of the potential leakage area. The holes in the nozzle base plate need only be large enough to accommodate the pins. Also, the pins are not subject to rotational movement, therefore, preventing premature wearing of the pins. Premature wearing of the pins can cause leakage and requires expensive and time consuming repair work.

The present invention allows for manual operation of the movable diffuser surface, since the means for rotating the drive ring extends outside the compressor housing. In the event of failure of the actuator or the control system, the actuator can be removed and the control shaft can be operated by hand to alter the position of the movable diffuser surface.

This system has the advantage of low weight, ease of manufacture, shock and vibration resistance, good system performance and additionally has an inherently high back impedance which will help prevent unintentional creep or movement of the movable diffuser surface.

It will be apparent to those skilled in the art that various modifications and variations can be made in the variable geometry diffuser of the present invention and in its construction without departing from the scope or spirit of the invention. As an example, the movable surface could be a portion of a wall of the diffuser instead of a ring. Additionally, a piston could be directly connected to the drive ring for causing rotation thereof. Furthermore, the special tracks or races could be formed on the inside diameter of the drive ring and the corresponding spherical pockets could be formed on the cylindrical outer surface of the nozzle base plate. In addition, it will be apparent that the variable geometry system of the present invention could be used in an analogous application, such as a pump.

Additional advantages and modifications will readily occur to those skilled in the art from consideration of the specification and practice of the invention disclosed herein. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

I claim:

1. A system for a variable capacity compressor having a diffuser, the capacity of which can be varied by changing the relative position of a fixed diffuser surface and a movable diffuser surface, the system comprising:

a nozzle base plate fixed to the compressor housing, said nozzle base plate having an axially elongated, cylindrical surface;

a drive ring coaxial with said annular nozzle base plate and positioned adjacent to and radially outward of said axially elongated surface of said nozzle base plate;

mechanical means between said base plate and said drive ring to translate rotational movement of said drive ring into axial movement relative to said base;

a push ring coaxially slidably received on said drive ring and positioned adjacent to and radially outward of said drive ring, said push ring being fixed relative to said drive ring in the axial direction;

means for connecting the push ring to the movable diffuser surface, said connecting means preventing rotational movement of said push ring; and means for rotating said drive ring.

2. A system for a variable capacity diffuser having a diffuser and a diffuser ring for varying the capacity of the diffuser, the system comprising:

a drive ring having ball pockets located therein;

an annular nozzle base plate having a planar section and a cylindrical projecting section;

a plurality of inclined races formed on the cylindrical projecting section of said base plate;

a plurality of drive balls located in the ball pockets and riding in the races;

a push ring rotatably interconnected with the drive ring and movable in an axial direction, wherein the push ring is located radially outward of the drive ring, no portion of the push ring projects, in the axial direction, beyond a plane substantially perpendicular to the axial direction and substantially parallel to a surface located at one end of the drive ring and a plane substantially perpendicular to the axial direction and substantially parallel to a surface located at another end of the drive ring, and axial movement of the drive ring axially displaces the push ring;

a plurality of pins connecting the push ring and the diffuser ring, the pins extending through apertures formed in the planar section of the nozzle base plate; and means at the interface of said pins and the apertures in the nozzle base plate for forming a seal between the pins and the base plate.

3. A system for a variable capacity compressor having a housing and a diffuser, the capacity of which can be varied by changing the relative position of a fixed diffuser surface and a movable diffuser surface, the system comprising:

moving means connected with the movable diffuser surface for moving the movable diffuser surface, the moving means being axially displaceable and inhibited from rotating relative to the movable diffuser surface, axial displacement of the moving means axially displacing the movable diffuser surface;

driving means connected with said moving means for driving the moving means, the driving means being axially displaceable and rotatable relative to said moving means, axial displacement of the driving means axially displacing the movable diffuser surface;

said moving means being slidably received on the driving means and located radially adjacent the driving means.

4. The system of claim 3, wherein the movable diffuser surface includes an annular ring disposed in the diffuser, the annular ring being axially movable toward and away from the fixed diffuser surface to vary the space between the annular ring and the fixed diffuser surface and thereby vary the size of the diffuser.

5. The system of claim 4, wherein the annular ring is flexible.

6. The system of claim 3, wherein the moving means includes an annular push ring and means connecting the annular push ring to the movable diffuser surface.

7. The system of claim 6, wherein the connecting means includes a plurality of pins attached to the annular push ring and the movable diffuser surface.

8. The system of claim 3, wherein the driving means includes a base and an annular drive ring, the annular drive ring mounted on the base and axially and rotatably movable relative to the base and engaging the moving means.

9. The system of claim 8, further comprising mechanical means between said base and said drive ring to translate the rotational movement of said drive ring into axial movement of said drive ring relative to said base.

10. The system of claim 9, wherein said mechanical means comprises inclined races formed on the base, a plurality of balls, and a plurality of pockets located on the annular drive ring for receiving the balls, the balls riding in the pockets and the races such that rotation of the drive ring moves the balls along the races and thereby controls the axial position of the drive ring.

11. The system of claim 9, wherein said mechanical means comprises inclined races formed on the annular drive ring, a plurality of balls, and a plurality of pockets located on the base for receiving the balls, the balls riding in the pockets and the races such that rotation of the drive ring moves the balls along the races and thereby controls the axial position of the drive ring.

12. The system of claim 8, wherein the moving means includes an annular push ring and means for connecting the annular push ring to the movable diffuser surface, a portion of the base being located between the driving means and the movable diffuser surface, the connecting means extending through holes in the base.

13. The system of claim 12, further comprising sleeves located in the holes in the base for creating a seal between the connecting means and the base.

14. The system of claim 12, further comprising O-rings located in the holes in the base for creating a seal between the connecting means and the base.

15. The system of claim 3, wherein a bearing is disposed between the moving means and the driving means.

16. The system of claim 15, wherein said bearing includes two races having running surfaces and a plurality of ball bearings between said races, the running surface of each of said races having a substantially gothic arch shaped cross section.

17. The system of claim 3, further comprising means for rotating the driving means, a portion of the rotating means extending outside of the housing of the compressor.

18. The system of claim 17, wherein the rotating means includes a position sensor for indicating the position of the movable diffuser surface.

19. The system of claim 17, wherein the rotating means includes an actuator located outside of the housing of the compressor, a control shaft, and a lever arm mounted on the control shaft and connected to the driving means.

20. The system of claim 19, wherein the actuator is an electrically operated actuator.

21. The system of claim 19, wherein the rotating means includes a position sensor for indicating the position of the movable diffuser surface, the position sensor being a feed back potentiometer located in the actuator.

* * * * *